United States Patent [19]

Höfler

[11] 4,287,695

[45] Sep. 8, 1981

[54] PREFABRICATED BUILDING

[75] Inventor: Alois Höfler, Walding, Austria

[73] Assignee: Lifehaus Corporation of Texas, New Braunsfels, Tex.

[21] Appl. No.: 29,635

[22] Filed: Apr. 13, 1979

[30] Foreign Application Priority Data

Jun. 19, 1978 [AT] Austria ..... 4426/78

[51] Int. Cl.[3] ..... E04H 1/00

[52] U.S. Cl. ..... 52/241; 52/122

[58] Field of Search ..... 52/122, 240, 241, 238

[56] References Cited

U.S. PATENT DOCUMENTS

| | | | |
|---|---|---|---|
| 1,363,407 | 12/1920 | Goudie | 52/695 |
| 2,001,574 | 5/1935 | Jacobson | 52/122 |
| 2,126,511 | 8/1938 | Soule | 52/695 |
| 2,958,982 | 11/1960 | Baker | 52/241 |
| 3,066,774 | 12/1962 | Dahme | 52/241 |
| 3,487,598 | 1/1970 | Lopina | 52/241 |
| 3,501,883 | 3/1970 | Birum | 52/241 |
| 3,553,915 | 1/1971 | Passovoy | 52/241 |
| 3,629,984 | 12/1971 | Richardson | 52/241 |
| 3,900,996 | 8/1975 | Yohe | 52/241 |

*Primary Examiner*—James A. Leppink
*Assistant Examiner*—Henry E. Raduazo
*Attorney, Agent, or Firm*—Kurt Kelman

[57] ABSTRACT

An outer wall comprises a load-carrying steel skeleton comprising a plurality of upright steel columns of square horizontal cross section and having a lower end anchored to a foundation, and an upper steel beam connecting the upper ends of the columns. A vertical bracket is mounted on each column. The bracket is of I-shaped horizontal cross section and defines between its outer and inner flanges two oppositely facing vertical guide channels extending parallel to the columns, two edge portions extending inwardly from the inner flange at an angle thereto, the inner flange and the two edge portions thereof fitting the cross section of the column. A plurality of vertical wall panels are aligned in a plane parallel to the columns and have edges slidingly received and engaged in the vertical guide channels.

2 Claims, 4 Drawing Figures

PREFABRICATED BUILDING

Figure 1:
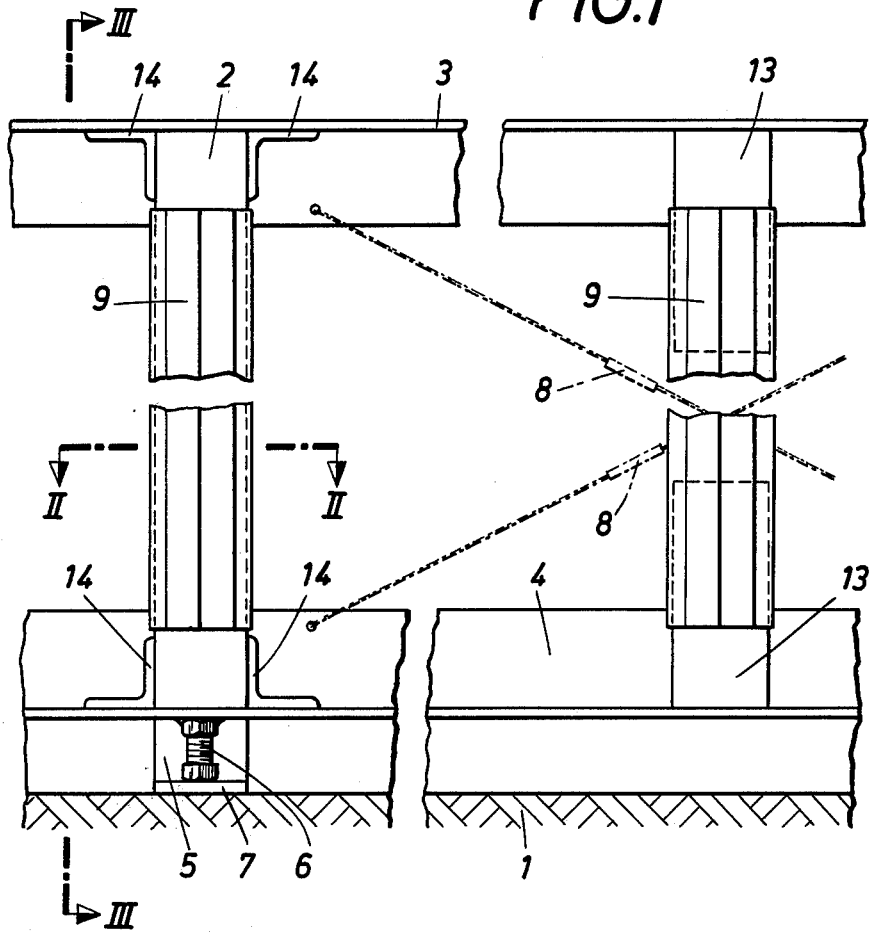

This invention relates to a prefabricated building, particularly to a prefabricated house, and is especially concerned with the outer walls of such building. Such outer wall comprises paneling and load-carrying steel skeleton frame which is anchored to the foundation and comprises columns and an upper beam which connects to the upper ends of the columns.

In the construction of prefabricated buildings, prefabricated wall elements have often been used, which consist of large self-carrying panels of wood or concrete. Owing to their heavy weight and large size, it was difficult to transport these wall elements and to handle them on the building site. Besides, they can be assembled only to form few predetermined types of buildings and do not permit individually preferred plan outline. Because the wall panels which are used must also carry loads, their structure must be selected mainly with a view to their load-carrying capacity although this will adversely affect their thermal and acoustical properties. Outer walls have been proposed in which loads are carried by a steel skeleton frame, which consists of columns and beams, whereas the spaces between the columns are filled by wall elements. These wall elements must also be large so that a selection is possible only from a restricted number of types of buildings. Besides, heat-conducting paths formed by the columns between the wall elements in the outer wall cannot be avoided.

It is an object of the invention to eliminate these disadvantages and to provide an outer wall which is of the kind described first hereinbefore and consists mainly of components which can be prefabricated and permit of constructing an outer wall which is virtually free from heat-conducting paths and can easily be transported and handled and can be assembled to form various different types of houses which may be individually preferred.

This object is essentially accomplished according to the invention by the provision of brackets which protrude outwardly and extend parallel to the columns and are secured to the columns or to the beams of the steel skeleton frame. Each of these brackets is approximately I-shaped and has a web that extends normal to the surface of the wall. Each bracket forms two channels for receiving aligned wall panels which are adjacent to each other. The columns and upper beams of the steel skeleton frame are delivered to the site and can be erected quickly and in a simple manner. This is made possible by suitable coupling elements provided on the upper beams and the columns. To anchor the skeleton frame to the foundation, the columns or the lower beam may be bolted to the foundation or may be welded to anchor plates, which have been inserted in the foundation. To provide the panelling it will then be sufficient to bolt the brackets to the skeleton frame which has been erected and to fit the panels into the channels of the brackets. It will be understood that the brackets need not be secured to the columns but may be secured only to the beams if the brackets are continuous. For this reason, regardless of the number of columns, the brackets can be arranged in accordance with the size of the panels which are available and in accordance with the desired plan outline so that the scope of architectural design is not restricted. Because the panels need not carry any load, they can be made only with a view to the desired thermal and acoustical properties, and because they are no longer separated by the columns there are no heat-conducting paths so that the desired damping and insulating properties can be imparted to the outer wall without involving an additional expenditure. The number and dimensions of the columns may be selected to provide a steel skeleton frame which can be used under the load conditions to be expected and which can carry a roof of any desired type. Roof frames of steel are particularly desirable and can simply be joined to the upper beams and combine a high load-carrying capacity with a relatively small cross-sectional area and permit of a large latitude in designing the roof. It is apparent that components which are relatively small in size and light in weight can easily and quickly be assembled to form outer walls which have a high load-carrying capacity and desirable thermal and acoustical properties and can be designed to suit individual preferences.

According to a preferred additional feature of the invention, the outer wall can be quickly and easily erected in a proper form if adjusting screws are provided, which are associated with the lower beams and serve to align the brackets and/or the skeleton frame and which bear on the substructure, preferably with bearing plates interposed, and angle irons are anchored in the substructure and serve to hold the parts in position when they have been aligned. Alternatively or in combination with the last-mentioned feature, adjacent columns may be biased by approximately diagonally acting, tensioned elements, which may consist of ropes that incorporate turn-buckles and which are connected to the columns to be biased or to the beams adjacent to said columns. When these features are adopted, the steel skeleton frame is initially only loosely erected and is then exactly levelled by means of the adjusting screws and is anchored after it has been levelled. For anchoring, it is sufficient to weld or bolt the lower beam to the angle irons. A vertical alignment can be accomplished with a few manual operations by which the tensioned elements are tightened or slackened. These tensioned elements add also to the stability of the structure.

It will be particularly desirable if, in accordance with a preferred feature of the invention, the inner flanges of the I-section brackets have angled edge portions, which laterally embrace the columns or vertical coupling elements which have been welded to the beams. Brackets having such inner flanges can be fitted on the columns and are sufficiently rigid so that they may extend continuously from one beam to the other and may be connected to the beams, e.g., by tubular coupling elements which are welded to the beams and have the same shape in cross-section as the columns.

Figure 2:
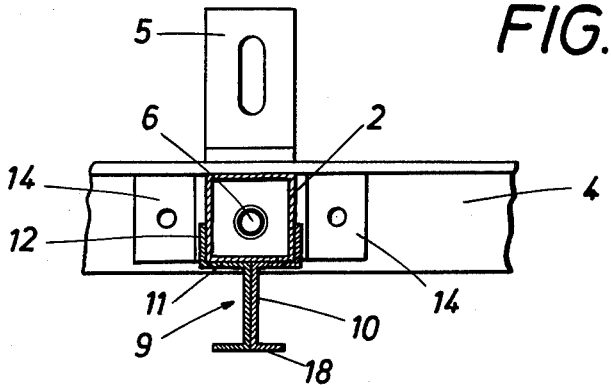
Figure 3:
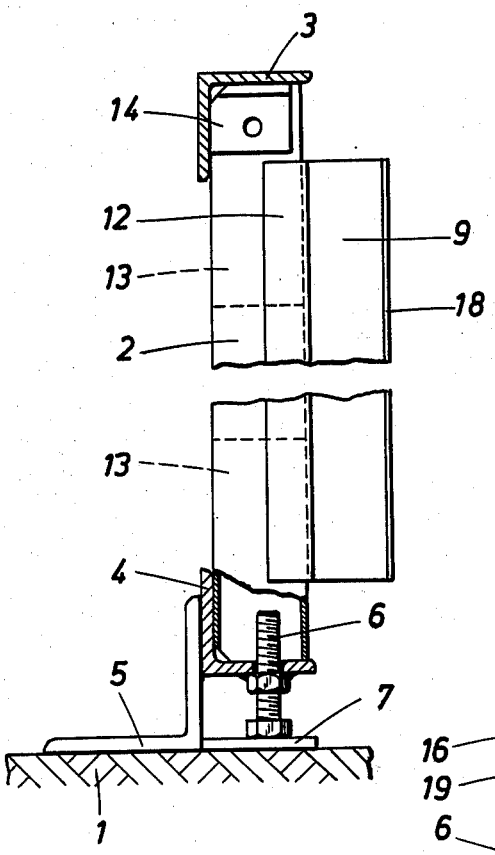
Figure 4:
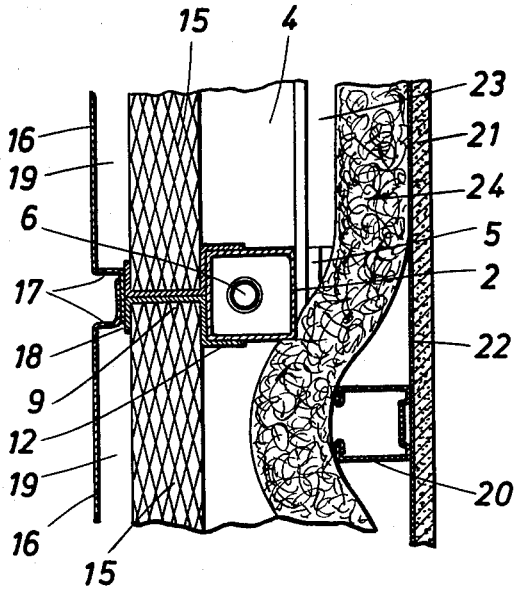

An embodiment of the invention is shown diagrammatically and by way of example on the drawings, in which FIG. 1 is a fragmentary elevation showing a portion of an outer wall according to the invention, viewed from the outside, with the panels omitted, FIGS. 2 and 3 are sectional views taken on lines II—II and III—III, respectively, and FIG. 4 is a horizontal sectional view showing a completed outer wall.

A load-carrying steel skeleton frame is carried by foundation 1, which consists of a basement or footings. The skeleton frame consists of upright columns 2, an upper beam 3 and a lower beam 4 and is fixed by means of angle irons 5, which have one flange that is welded to the lower beam 4 and another flange which is anchored in the substructure 1, e.g., by means of dowels. To permit levelling of the steel skeleton frame, the lower beam 4 is provided adjacent to the columns 2 with adjusting screws 6, which bear on the substructure 1 through the intermediary of thrust plates 7. To align the steel skeleton frame, the lower beam 4 can be exactly levelled by an appropriate rotary adjustment of the adjusting screws 6. When the steel skeleton frame has been levelled, it is fixed in position by welding together lower beam 4 and angle irons 5. If it is necessary to align the columns 2 to a vertical position, this can be accomplished by means of cables with turnbuckles 8 which extend approximately diagonally between adjacent columns. These cables are indicated by dash-dot lines in the drawing.

Vertical brackets 9 which are approximately I-shaped in cross-section are secured to the steel skeleton frame and protrude outwardly therefrom and form guide channels 10 for receiving aligned panels which are adjacent to each other. Each of these brackets 9 may consist of a single piece or may be assembled from two pieces and possesses an inner flange 11, which has angled edge portions 12 to fit the cross-sectional shape of the associated column 2. The brackets can be simply fitted on the columns or on upright coupling elements 13, of the same cross-sectional shape as the columns and welded to beams 3 and 4 between respective columns 2. The columns 2 and the coupling elements 13 consist of square-section tubes, and the beams 3, 4 consist of angle sections receiving columns 3 and coupling elements 13. As a result, the components of the steel skeleton frame can be readily assembled and the wall has on the outside a closed surface, on which water of condensation can be conducted to the outside. Means for connecting the columns and beams are provided and may consist of angle irons 14, bolted or welded to the columns and beams. Such steel skeleton frame can be economically assembled from prefabricated parts so that the design and arrangement of the wall may be selected as desired.

As is apparent from FIG. 4, the outer wall is completed by inserting panels 15, from above into guide channels 10 of brackets 9, so that the wall is provided with a closed panelling, which is virtually free from heat-conducting paths. Because any loads to be carried by the outer wall will be carried by the steel skeleton frame, the panels may be made from a material which has been selected with a view to its insulating and noise absorbing properties. For instance, simple panels made of polycinyl chloride can be used. An outer facing consists preferably of panels 16 of galvanized sheet steel, which carry a plastic finish on the outside. These sheet steel panels 16 have Z-shaped vertical edge portions 17, which are angled inwardly and by which the overlapping panels 16 are secured directly to the outer flanges 18 of the brackets, e.g., by rivets. In such an arrangement, the panels 15, the sheet steel panels 16 and the edge portions of the latter define air gaps 19, which act like a chimney so that the outer facing will be excellently ventilated. A holding frame 20 is provided on the inside of the outer wall and is spaced from the steel skeleton frame and carries an inner facing of fire-proof panels 21, which consist of plasterboard and have heat-absorbing and vapor barrier layer 22. Between the panelling and the inner facing there is a space 23 which contains a body of stagnant air having good insulating properties, and there is also space for an additional insulating layer, e.g., a layer 24 of regenerated cellulose fibers. These elements ensure that the outer wall has excellent thermal and acoustic properties.

What is claimed is:

1. An outer wall of a prefabricated building affixed to a foundation, which comprises:

(a) a load-carrying steel skeleton frame extending in a vertical plane and comprising (1) a plurality of upright steel columns spaced apart in said plane, each column being of substantially square horizontal cross section, and (2) an upper steel beam coupled to the upper ends of the columns and a lower steel beam coupled to the lower ends of said column to form the skeleton frame therewith, said lower steel beam being anchored to the foundation, (b) a plurality of continuous vertical brackets extending between each of said beams and mounted on at least one of said steel columns, said brackets being of substantially I-shaped substantially horizontal cross section and of integral construction and having two U-shaped segments joined back to back each of which define a central web projecting perpendicularly to the vertical plane from the column, an outer flange extending parallel to said plane, and an inner flange extending parallel to said plane, the web and the inner and outer flanges defining therebetween two oppositely facing vertical guide channels extending parallel to said plane, said segments each also including an edge portion extending inwardly and normally from an outer end of said inner flange, the inner flange and the edge portion of each segment cooperatively fitting and laterally embracing the square cross section of the column, said segments each extending continuously from said edge portion to said outer flange thereof, (c) a plurality of upright coupling elements arranged between respective ones of the upright steel columns, the coupling elements having upper and lower ends respectively welded to the upper and lower beams, the coupling elements having the same square horizontal cross section as the columns, and a respective one of the vertical brackets mounted on each upright coupling element, and (d) a plurality of vertical wall panels aligned in a plane parallel to said vertical plane, the wall panels having edges slidingly received and engaged in the vertical guide channels of said brackets.

2. The outer wall of claim 1, wherein said brackets are of unitary construction.

* * * * *